US007017488B2

(12) United States Patent
Ruschkowski

(10) Patent No.: US 7,017,488 B2
(45) Date of Patent: Mar. 28, 2006

(54) WASHING AND CLEANING DEVICE FOR CYLINDERS, ESPECIALLY PRINTING FORM CYLINDERS AND OFFSET BLANKET CYLINDERS IN A PRINTING MACHINE COMPRISING A TIMING MECHANISM FOR A CONTINUOUS CLEANING CLOTH

(75) Inventor: Johannes Ruschkowski, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 18 days.

(21) Appl. No.: 10/510,608

(22) PCT Filed: Apr. 9, 2003

(86) PCT No.: PCT/EP03/03653

§ 371 (c)(1),
(2), (4) Date: Oct. 8, 2004

(87) PCT Pub. No.: WO03/084756

PCT Pub. Date: Oct. 16, 2003

(65) Prior Publication Data

US 2005/0126412 A1 Jun. 16, 2005

(30) Foreign Application Priority Data

Apr. 11, 2002 (DE) ..... 102 16 058

(51) Int. Cl.
*B41F 35/02* (2006.01)

(52) U.S. Cl. ..... 101/425; 101/423; 15/256.5; 15/256.51; 15/256.53

(58) Field of Classification Search ..... 101/425
See application file for complete search history.

(56) References Cited

U.S. PATENT DOCUMENTS 4,058,059 A * 11/1977 Moestue ..... 101/425

(Continued)

FOREIGN PATENT DOCUMENTS

DE 38 41 260 A1 3/1990

(Continued)

*Primary Examiner*—David Gray
*Assistant Examiner*—Joshua D Zimmerman
(74) *Attorney, Agent, or Firm*—Cohen, Pontani, Lieberman & Pavane

(57) ABSTRACT

An erasing and cleaning apparatus for cylinders an erasing and cleaning apparatus for cylindrical surfaces in a printing press includes a positioning unit with side walls and a cleaning cloth transport device arranged in said positioning unit and having a clean cloth roll, a wash roll, and a dirty cloth roll. An intermittently operated pneumatic or hydraulic linear drive having a stroke movement is connected to said cleaning cloth transport device for advancing a cleaning cloth off of the clean cloth roll, over the wash roll, and onto the dirty cloth roll. At least one of the sidewalls includes bearing elements for the clean cloth roll, the wash roll, and the dirty cloth roll. A gearwheel is connected to one of the bearing elements by one of a freewheeling and overrunning clutch for converting the stroke movement of the drive into a rotary movement. The apparatus also includes a cam control system for controlling a stroke limitation in response to a winding radii of the cleaning cloth on the dirty cloth roll and an integrated braking device generating a braking force for counteracting a pulling direction of said intermittently operated drive, the braking force also being adjustable in response to the winding radii of the cleaning cloth on the dirty cloth roll.

8 Claims, 3 Drawing Sheets

U.S. PATENT DOCUMENTS

| | | | |
|---|---|---|---|
| 4,986,182 | A | 1/1991 | Sawaguchi et al. |
| 5,377,591 | A | 1/1995 | Lippold et al. |
| 5,727,470 | A | 3/1998 | Kurzer et al. |
| 6,694,879 | B1 | 2/2004 | Schuster et al. |

FOREIGN PATENT DOCUMENTS

| | | | |
|---|---|---|---|
| DE | 44 42 412 | A1 | 5/1996 |
| DE | 100 08 214 | A1 | 8/2001 |
| EP | 0 611 652 | A1 | 8/1994 |

* cited by examiner

WASHING AND CLEANING DEVICE FOR CYLINDERS, ESPECIALLY PRINTING FORM CYLINDERS AND OFFSET BLANKET CYLINDERS IN A PRINTING MACHINE COMPRISING A TIMING MECHANISM FOR A CONTINUOUS CLEANING CLOTH

PRIORITY CLAIM

This is a U.S. national stage of application No. PCT/EP03/03653, filed on 9 Apr. 2003. Priority is claimed on that application and on the following application(s): Country: Germany, Application No.: 102 16 058.9, Filed: 11 Apr. 2002.

BACKGROUND OF THE INVENTION

1. Field of the Invention

The invention relates to an erasing and cleaning apparatus, also called an erasing station, for cleaning cylindrical surfaces, in particular of printing form and blanket cylinders within printing presses with the aid of a cleaning cloth which can be moved by cleaning cloth transport means and which can be advanced intermittently.

2. Description of Prior Art

A cleaning system for printing forms is known, for example, U.S. Pat. No. 5,727,470 which discloses a method and an apparatus for controlling the washing operation in a printing press. The object to be achieved in that publication is based on the fact that it is necessary to make the control system for advancing the cleaning cloth more precise, more reliable and more flexible. This object is essentially achieved in that publication in that the cleaning cloth transport system receives pulses which are proportional to the travel from a clocked gear wheel via a sensor, which pulses are used for controlling the drive motors for the transport means of the cleaning cloth, in order for it to be possible to keep the respective transport paths of the cleaning cloth approximately constant.

In order to achieve defined transport paths, the transport path of the cleaning cloth is detected by the sensor device in the forward and backward direction. An exchangeable unit known as a washing slide-in unit has a sensing device in the form of a clocking shaft, on which the cleaning cloth rolls, and a sensor which is fastened to the printing press and senses a toothed clocking wheel connected to the clocking shaft, the thickness of the clean cloth roll also being sensed by a resiliently pressed-on lug which interacts mechanically with a second sensor on the press. A measure of the transport speed of the cleaning cloth which is simple to form is the frequency of the signals which is obtained from regular markings.

The abovementioned known arrangement requires a separate control mechanism which necessitates material expenditure and additionally considerable outlay on maintenance.

Furthermore, U.S. Pat. No. 6,694,879 discloses a generic cleaning apparatus for cleaning the surface of a blanket cylinder or any desired cylinder of a printing unit, having an intermittently operated drive for the continuous cleaning cloth. The transport means for the cleaning cloth likewise essentially comprise a clean cloth roll and a dirty cloth roll for receiving the cleaning cloth which is impregnated with wash fluid and is pulled off from the clean cloth roll to the dirty cloth roll. Here, the cleaning cloth is always held under tensile stress by pressure means in the form of a wash roll.

The cleaning apparatus is configured, in particular, as a slide-in system and, in the installed state, is assigned to the cylindrical body which is to be cleaned. The cleaning apparatus is brought into and out of contact with the cylinder by a positioning unit. A washing fluid supply system fixed to the machine is assigned to the cleaning apparatus. The clean cloth roll, the wash roll and the dirty cloth roll are mounted rotatably in two side parts arranged in parallel with one another. The wash roll has a shaft which has an elastic coating and serves as a pressure element in order to press the cleaning cloth against the cylindrical body and simultaneously guide the cleaning cloth. The side parts of the slide-in system are connected to one another via a cross-member. The cleaning cloth is guided in as large a wrapping angle as possible from the clean cloth roll over the wash roll in the pulling direction of the dirty cloth roll. The cleaning cloth is wetted with a washing fluid. Drive is imparted to the dirty cloth roll via a shaft and gear wheel. The dirty cloth roll is operated intermittently and pulls the cleaning cloth from the clean cloth roll over the wash roll step by step, which brings the cleaning cloth into contact with the cylindrical body to be cleaned, in the pulling direction and accommodates the cleaning cloth on a shaft. The intermittently operated drive has up to now been imparted to the dirty cloth roll in a conventional manner via an (electric) motor or a pneumatic or hydraulic drive element, such as a compressed air cylinder, a drive shaft or rod and a gear wheel chain.

One disadvantage of the previous solutions of a mechanical intermittently operated drive is that the duration of a work cycle, which results in the respective transport path for the cleaning cloth, always remains constant and no consideration is thus taken of the occurrence of a transport path difference for the intermittent cloth advancing operation as a function of the decrease in the cloth supply on the clean cloth roll or of the increase in the winding radius on the dirty cloth roll. The cycle duration (of the work cycle) or thee cycle rate should be at its greatest when the clean cloth roll is full (maximum cloth supply), in order to wind up a certain cloth length with a small winding radius of the dirty cloth roll, and should become smaller and smaller as the winding radii of the dirty cloth roll become greater, in order to maintain the certain cloth length, that is to say a constant transport path, with the result that a transport path difference which occurs given a constant cycle duration on account of the varying winding radius could be compensated for, or in order to keep the advancing of the cloth (transport path of the cloth) constant over the entire use period (the time it takes to convey the cleaning cloth from the clean cloth roll to the dirty cloth roll, that is to say until the cloth supply is exhausted).

Furthermore, the cleaning cloth always has to be held under tensile stress for known reasons. For this purpose, various braking devices for the shaft of the clean cloth roll, such as spring-actuated brakes, which counteract the rotational direction of the clean cloth roll when the cloth is advanced are already known (see. e.g., U.S. Pat. No. 5,377,591). Consideration is once again not taken here of the fact that the pulling force on the cleaning cloth decreases in the case of a driven dirty cloth roll when the winding radii on the dirty cloth roll become greater, and the braking action on the clean cloth roll which counteracts the rotational direction then has to become smaller when the winding radii on the dirty cloth roll become greater in order not to bring about ever increasing cloth tension or even standstill of the cloth advancing if the braking action is greater than the pulling force.

SUMMARY OF THE INVENTION

It is therefore an object of the present invention to develop the intermittently operated drive for a cleaning cloth for an erasing and cleaning apparatus of the generic type in such a way that the above-described disadvantages are eliminated.

The object is achieved by an erasing and cleaning apparatus for cylinders an erasing and cleaning apparatus for cylindrical surfaces in a printing press including a positioning unit with side walls and a cleaning cloth transport device arranged in said positioning unit and having a clean cloth roll, a wash roll, and a dirty cloth roll. An intermittently operated pneumatic or hydraulic linear drive having a stroke movement is connected to said cleaning cloth transport device for advancing a cleaning cloth off of the clean cloth roll, over the wash roll, and onto the dirty cloth roll. At least one of the sidewalls includes bearing elements for the clean cloth roll, the wash roll, and the dirty cloth roll. A gearwheel is connected to one of the bearing elements by one of a freewheeling and overrunning clutch for converting the stroke movement of the drive into a rotary movement. The apparatus also includes a cam control system for controlling a stroke limitation in response to a winding radii of the cleaning cloth on the dirty cloth roll and an integrated braking device generating a braking force for counteracting a pulling direction of said intermittently operated drive, the braking force also being adjustable in response to the winding radii of the cleaning cloth on the dirty cloth roll.

By virtue of the fact that all the cleaning cloth transport means including the cleaning cloth are packaged in an independent cassette and a modular positioning unit can be arranged fixedly in the printing press, it is possible to use the cassette universally in the printing press for any desired cylinder, it being necessary only to arrange a positioning unit. The cleaning apparatus does not need to be completely exchanged, but rather only the independent cassette has to be removed from the positioning unit.

The configuration according to the invention of the intermittently operated drive for the dirty cloth roll and the particularly advantageous configuration of a variable braking device for the clean cloth roll ensure identical forward feeding, that is to say a constant transport path of the cleaning cloth and a uniform tensioning of the cloth between the cleaning cloth transport means, at all times, with the result that, for example, a non-uniform characteristic in the transport on account of the decrease in roll thickness of the clean cloth roll or the increase in the winding radius of the dirty cloth roll is compensated for reliably.

It is particularly advantageously possible to implement all the functions of the previous intermittently operated drive in a very small installation space, and also, furthermore, to eliminate all the above-described disadvantages, by means of the intermittently operated drive according to the invention which substantially comprises a pneumatically or hydraulically driven linear drive, which has a limited stroke and whose stroke movement is converted into a rotational movement by a gear wheel placed on the bearing unit to be driven with a preferably dual freewheeling or overrunning clutch, a stroke limitation system by means of a variably adjustable cam control system, and an integrated variably adjustable brake.

BRIEF DESCRIPTION OF THE DRAWINGS

In the drawings, wherein like reference characters denote similar elements throughout the several views.

DETAILED DESCRIPTION OF THE PREFERRED EMBODIMENTS

Figure 5:
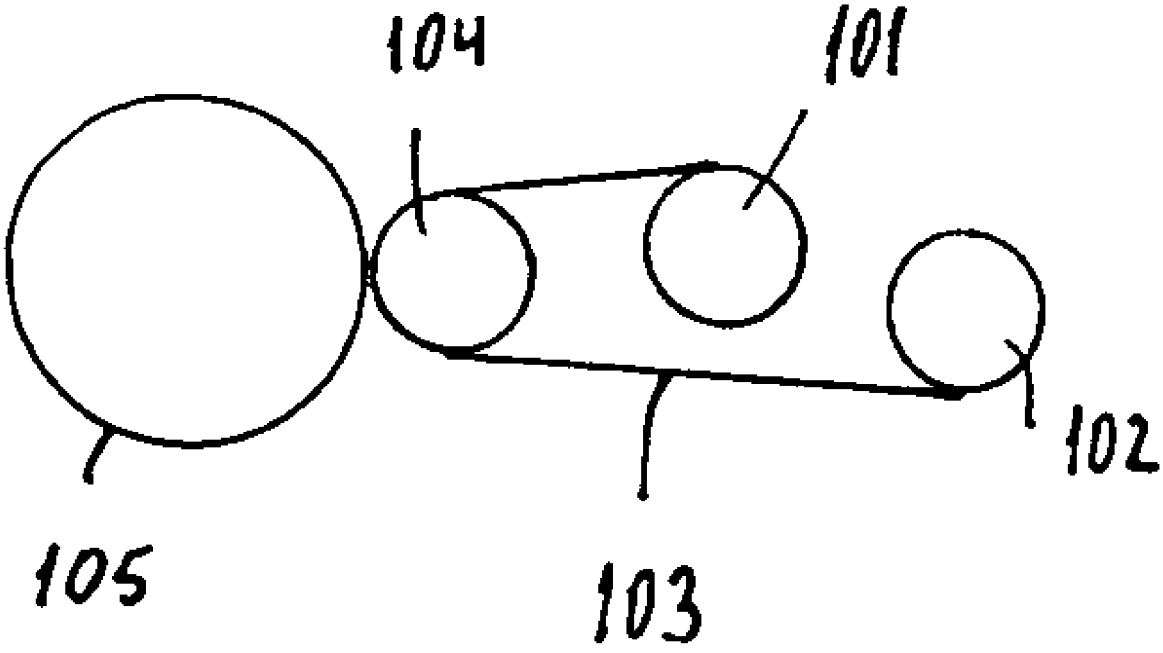

As shown in FIG. 5, the apparatus for erasing and cleaning cylindrical surfaces comprises a clean cloth roll 101, a dirty cloth roll 102 for receiving the used cleaning cloth 103, and a pressure element 104, in particular a wash roll, which presses the cloth 103 against a cylindrical surface 105.

These cleaning cloth transport means are integrated, together with the cleaning cloth, in a prepackaged cassette and provided for insertion into a slide-in system arranged fixedly in the printing press in the form of a positioning unit having the features described in U.S. Pat. No. 6,694,879. As is known, the positioning unit comprises two side parts which are arranged parallel to one another and are connected to one another via a crossmember to form a superstructure into which all the necessary supply units are introduced. The side parts house bearing elements which interact with the cleaning cloth transport means of an inserted cassette. That is the cassette can be placed on the positioning unit and can be connected to the latter with a form-fitting and force-transmitting fit, for instance approximately in the same way as a video cassette in its associated drive, a drive for the cleaning cloth transport means being mounted pivotably on the positioning unit in a known manner, with the result that the positioning unit and the drive are present in a modular design.

A drive motor therefore serves to drive the cleaning cloth and is controlled by a computing program which can make it possible to advance the cleaning cloth section by section and transport it backward partially after every cleaning operation and finally rewind the used cleaning cloth from the dirty cloth roll to the clean cloth roll.

Figure 1:
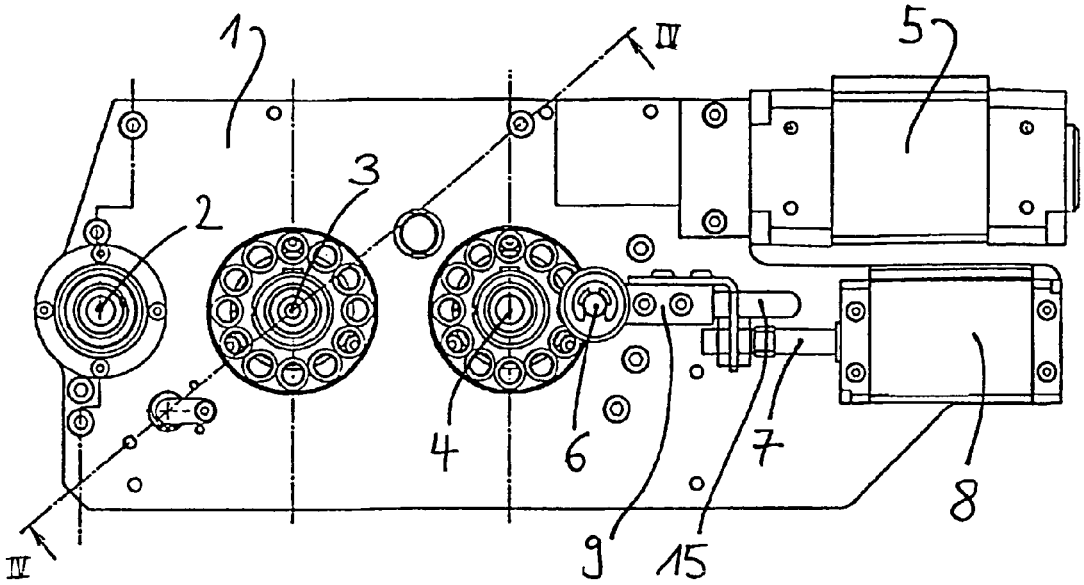
FIG. 1 is a side view of a side wall of the positioning unit for the cleaning cloth, showing bearing elements which can be connected with a form-fitting and force-transmitting fit to the cleaning cloth transport means which are housed in an exchangeable cassette.

FIG. 1 shows one of the side walls 1 of the positioning unit for the cleaning cloth. Bearing elements 2, 3, 4 for the wash roll, the clean cloth roll and for the dirty cloth roll are in each case provided approximately in the center plane in the longitudinal direction and can be connected to the latter, which are housed in an exchangeable cassette, with a form-fitting and force-transmitting fit. The opposite side wall of the positioning unit is configured in a corresponding manner.

According to the invention, the cleaning cloth is advanced at at least one side wall 1 by a linear drive 5, preferably in the form of a pneumatic cylinder which has a limited stroke, it being possible to adjust the stroke limitation via a pick-up 6 on the dirty cloth roll. The intermittently operated drive on one side wall 1 will be described in the following text. The opposite side wall can be configured in an identical manner and with a synchronous function, but this is not necessary for the intended function.

The pick-up 6 is realized by means of a small wheel, which rolls with clear contact 9 on the cleaning cloth on the dirty cloth roll, on a guide rod 7 which is held by a control housing 8 and can be moved transversely in the direction of the control housing 8 as the winding radius increases, the control housing 8 using a hydraulic or pneumatic control means to counter this movement and therefore opposing the pick-up 6 with a restoring force which is comparable with a spring force.

Figure 2:
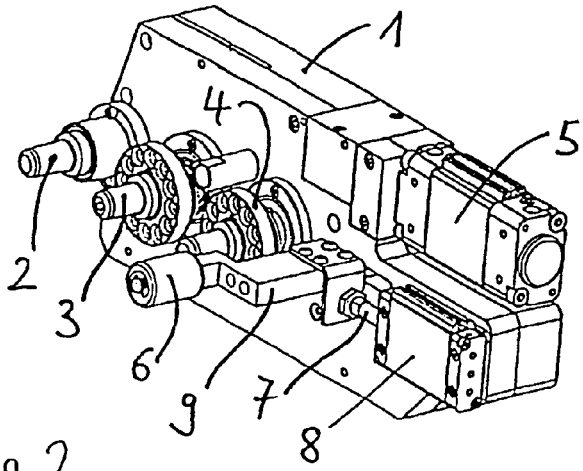
FIG. 2 is a perspective view of the subject matter of FIG. 1.

Using the same designations, FIG. 2 shows a perspective view of the side wall 1 according to FIG. 1. The path of the transverse movement of the small wheel 6 with the guide rod 7 is the measure of the increase or decrease in the winding radius of the dirty cloth roll.

Figure 3:
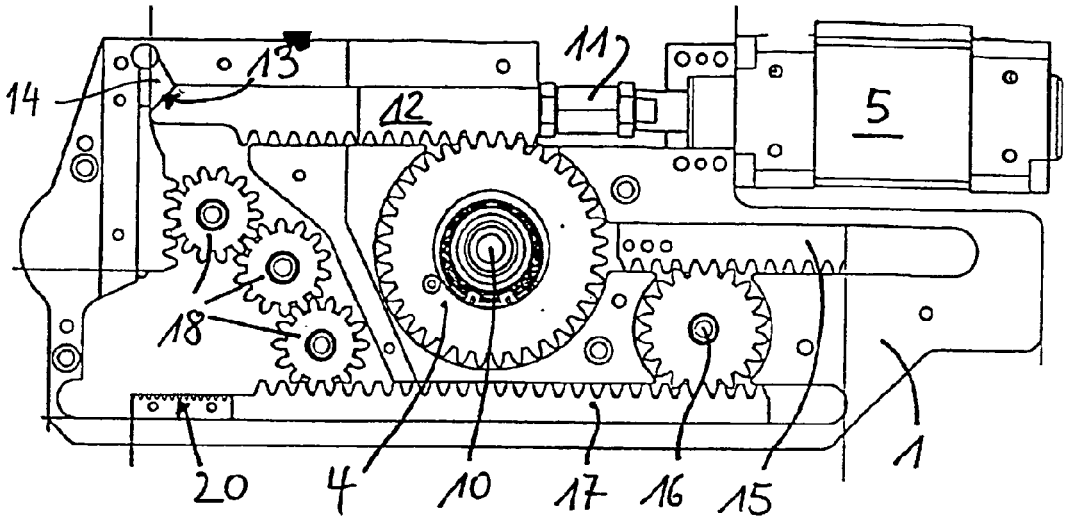
FIG. 3 is a sectional view of the drive according to the invention which can be transmitted to the dirty cloth roll of the cleaning cassette and is operated intermittently.

FIG. 3 illustrates the cut-open side wall 1. A gear wheel 10 is placed concentrically on the bearing element 4 for introducing the intermittently operated drive for the dirty cloth roll. A gear wheel rod 12 which is in an approximately tangential position with respect to the circumference of the gear wheel 10 is mounted pivotably on the linear drive 5, that is to say on a pneumatic cylinder, by means of a guide rod 11. The gear wheel rod 12 is in clear contact with a guide surface of the linear drive 5, meshes with the gear wheel 10 on the bearing element 4 and has a stroke-limiting stop surface 13 at its end which is remote from the guide rod 10.

The gear wheel 10 is fitted to the bearing element 4 by means of a preferably dual (switchable for both rotational directions) freewheeling or overrunning clutch which is switched by the relative rotations of two clutch halves, as they are known, the torque usually being transmitted in the relative rotational direction in which the freewheel locks frictionally by clamping friction, with the result that the freewheeling or overrunning clutch is locked when the dirty cloth roll is rotated in the pulling direction of the cleaning cloth and freewheels in the opposite direction.

In this way, the rack 12 forms the pulling element for the intermittently operated drive of the gear wheel 10 on the bearing element 4, which pulling element imparts the drive to the dirty cloth roll. That is to say, the gear wheel 10 converts the stroke movement or stroke length of the rack 12 of the linear drive into an intermittent rotational movement, it being possible to predefine the cycle duration using the stroke length of the rack 12.

The rack 12 can be moved transversely against a stop cam element 14 movably arranged in the side wall 1 by means of the guide rod 11, which can be controlled by the pneumatic cylinder 5, with the stop surface 13, and the bearing element 4 for the dirty cloth roll can be moved in the corresponding direction by this stroke movement. When the rack 12 is withdrawn into the initial position, the gear wheel 10 freewheels, with the result that the bearing element 4 is driven intermittently, the cycle duration being limited by the stroke length, that is to say the path length of the rack 12 from the defined initial position of the transverse movement to the stop of the stop surface 13 on the stop cam element 14, and being interrupted by the restoring movement of the rack 12 into the initial position.

As is shown in FIGS. 1 and 2, the small wheel 6 which rolls on the cleaning cloth on the dirty cloth roll can be moved by means of the guide rod 7 transversely in accordance with the changing winding radii. Here, a further rack 15 is assigned in clear contact with the stop 9 to the guide rod 7, which rack 15 meshes with an intermediate gear wheel 16 and drives the latter in accordance with the linear movement. The intermediate gear wheel 16 converts its rotation via a third rack 17 into a linear movement again which drives a gear wheel chain 18 and thus displaces the stop cam element 14 via a corresponding meshing point in a plane which is perpendicular with respect to the direction of movement of the rack 12 which sets the timing, in order to vary the cycle duration via the changed stroke length of the rack 12 in accordance with the machined cam shape.

By tapping off the winding state (winding radius of the dirty cloth roll in the cassette) by means of the small wheel 6 and the rack 15 mounted pivotably via the guide rod 7 and by displacing a further rack 17, which drives a gear wheel chain 18, in an appropriate and defined manner, the stop cam element 14 can be displaced and therefore the stroke length of the rack 12, which sets the timing, of the linear drive 5 can be varied in accordance with the changing winding radii of the dirty cloth roll.

It is thus possible to keep the transport length of the cleaning cloth per cycle constant using a linear drive 5 whose drive cycle is defined by the stroke length of a rack 12 which can move to and fro transversely, it being possible to vary drive cycle by means of a displaceable stop cam element 14 for the rack 12 and the displacement of the stop cam element 14 resulting from the winding radius of the dirty cloth roll being sensed via a sequence of racks 15, 17 and intermediate gear wheels 16, 18. The cam profile shape of the stop cam element 14 is calculated numerically and defines the change in cycle duration. A great length is required for the linear movement of the rack 12 at the beginning of the winding operation, that is to say given a small winding radius of the dirty cloth roll; said length for the linear movement of the rack 12 has to become smaller and smaller as the winding radii increase. This requirement is met by the stop surface 13 coming into contact with the changing cam profile of the stop cam element 14 more and more quickly.

Figure 4:
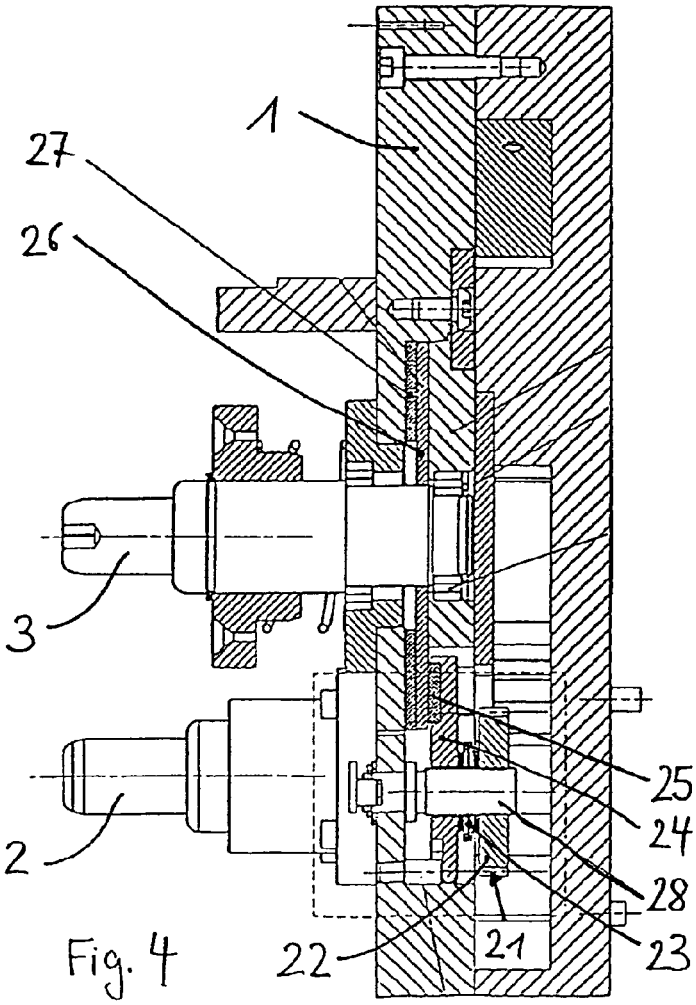
FIG. 4 is a sectional view IV—IV through FIG. 1 with a braking device which counteracts the intermittently operated drive and FIG. 5 is a schematic diagram of the cleaning cloth transport device.

FIG. 4 shows a further detail of the configuration of the invention in the form of a sectional view IV—IV through FIG. 1 with a braking device which counteracts the intermittently operated drive.

The braking device is realized in the form of a disk brake on the bearing element 3, via which disk brake the braking forces are imparted to the clean cloth roll. Here, the transmission of force is determined by the frictional forces between a brake block, brake linings and brake disk.

For this purpose, in the side wall 1, the rack 17 which drives the gear wheel chain 18 to displace the stop cam element 14 is assigned an axle 28 on which a threaded nut 22 is arranged, having circumferential teeth 21 which mesh with the teeth of a continuation 20 of the rack 17. The linear movement of the rack 17 can rotate the threaded nut 22 on the axle 28 against a stop bolt 23 which, in the state in which it is acted on by the threaded nut 22, tilts a brake block 24 arranged behind the axle 28 against a brake lining 25 and therefore increases the frictional force on the brake lining 25 and, in the state in which it is not loaded by the threaded nut, releases the brake block 24 arranged behind it and therefore reduces the frictional force on the brake lining 25.

By tilting the brake block 24, the brake lining 25 can be set against a brake disk 26 on the bearing element 3 for the clean cloth roll, which brake disk 26 can be pressed in turn against a further brake lining 27 which lies in parallel and is fixed in the side wall. In this way, a very effective variable braking device is realized for the clean cloth roll.

As, according to the object set, the braking force which counteracts the rotational direction of the clean cloth roll is intended to become smaller and smaller as the winding radii of the dirty cloth roll become greater, and at the same time the cycle duration or the stroke travel of the linear drive is likewise intended to become smaller and smaller as the winding radii of the dirty cloth roll become larger, the displacement of the stop cam element 14, that is to say the setting of the variable travel length of the cycle stroke, is particularly advantageously coupled to the internal setting of the variable disk brake 23 to 27 by means of the continuation 20 of the rack 17 and the circumferential teeth 21 of the threaded nut 22.

Furthermore, the positioning unit itself preferably comprises an electric motor drive and a conversion means into a linear movement (for example via gear wheels and a threaded drive) for engaging and disengaging it operationally.

The erasing and cleaning apparatus is suitable in general for cleaning cylindrical surfaces inside and outside printing presses with the aid of a modular sheet transport unit, but it can preferably be used to clean systems which permit rapid changing of the image-setting means in a lithographic method without removing the printing form. Printing-on-demand systems and computer-to-plate systems may be mentioned here by way of example.

What is claimed is:

1. An erasing and cleaning apparatus for cylindrical surfaces in a printing press, comprising:

a positioning unit including side walls;

a cleaning cloth transport device arranged in said positioning unit and comprising a clean cloth roll, a wash roll, and a dirty cloth roll;

an intermittently operated drive comprising one of a pneumatic and hydraulic linear drive having a stroke movement and connected to said cleaning cloth transport device for advancing a cleaning cloth from said clean cloth roll, over said wash roll, and onto said dirty cloth roll;

at least one of said sidewalls comprising bearing elements for said clean cloth roll, said wash roll, and said dirty cloth roll;

a gearwheel connected to one of said bearing elements by one of a freewheeling and overrunning clutch for converting said stroke movement to a rotary movement;

a cam control system for controlling a stroke limitation, said stroke limitation being adjustable in response to a winding radii of the cleaning cloth on said dirty cloth roll; and an integrated braking device generating a braking force for counteracting a pulling direction of said intermittently operated drive, said braking force being adjustable in response to the winding radii of the cleaning cloth on said dirty cloth roll.

2. The erasing and cleaning apparatus of claim 1, wherein said gearwheel is connected concentrically with the one of said bearing elements corresponding to said dirty cloth roll, said erasing and cleaning apparatus further comprising a gearwheel rod pivotally mounted in an approximately tangential position relative to said gearwheel in meshed engagement with said gearwheel, said gearwheel rod being connected to said linear drive by a guide rod.

3. The erasing and cleaning apparatus of claim 2, wherein said cam control system comprises a stop cam element, said gearwheel rod comprising a stop surface at an end remote from said guide rod, wherein said stop surface is movable against said stop cam element for limiting said stroke movement.

4. The erasing and cleaning apparatus of claim 3, further comprising a small wheel connected to a guide rod and moving transversely in response to a winding radii of the cleaning cloth on said dirty cloth roll, a further rack connected to said guide rod and in meshed engagement with an intermediate gearwheel, a third rack connected to said intermediate gearwheel and driving a gear wheel chain to displace said stop cam element, and thereby adjust said stroke limitation.

5. The erasing and cleaning apparatus of claim 1, wherein said integrated braking device comprises a disk brake mounted on the one of the bearing elements corresponding to said clean cloth roll.

6. The erasing and cleaning apparatus of claim 5, wherein said integrated braking device and said cam control system are coupled.

7. The erasing and cleaning apparatus of claim 4, wherein said braking device comprises a threaded nut being arranged on an axle in said at least one of said side walls and having circumferential teeth, said third rack having a continuation in meshed engagement with said circumferential teeth of said threaded nut, said braking device further comprising a stop bolt, a tiltable brake lock, and a brake lining, said threaded nut being reversibly rotatable against said stop bolt by linear movement of said third rack for tilting said brake block against said brake lining for increasing a frictional force on the brake lining.

8. The erasing and cleaning apparatus of claim 7, wherein said braking device comprises a brake disk arranged on said one of said bearing elements corresponding to said clean cloth roll, said brake lining being movable against said brake disk in response to tilting of said brake lock for increasing the frictional force between said brake lining and said brake disk.

* * * * *